US007261543B2

(12) United States Patent
Lester

(10) Patent No.: US 7,261,543 B2
(45) Date of Patent: Aug. 28, 2007

(54) APPARATUS AND METHOD FOR MOUNTING ACCESSORIES TO POTTERY WHEELS

(76) Inventor: Samuel Lester, 107 Ridgeview Dr., Lynchburg, VA (US) 24503

( * ) Notice: Subject to any disclaimer, the term of this patent is extended or adjusted under 35 U.S.C. 154(b) by 397 days.

(21) Appl. No.: 10/894,694

(22) Filed: Jul. 20, 2004

(65) Prior Publication Data

US 2006/0016060 A1 Jan. 26, 2006

(51) Int. Cl.
*B21D 39/03* (2006.01)

(52) U.S. Cl. ..... 425/182; 29/464; 425/263; 425/459

(58) Field of Classification Search ..... 425/182, 425/263, 459; 29/464
See application file for complete search history.

(56) References Cited

U.S. PATENT DOCUMENTS

| | | | | |
|---|---|---|---|---|
| 406,350 | A | | 7/1889 | Jackson |
| 735,355 | A | | 8/1903 | Fisher |
| 1,377,785 | A | | 5/1921 | Odelberg |
| 2,968,080 | A | * | 1/1961 | Threlfall ..... 269/304 |
| 3,849,054 | A | | 11/1974 | Jordache |
| 4,028,041 | A | | 6/1977 | Zambrano, Jr. |
| 4,222,577 | A | | 9/1980 | Giffin |
| 4,332,542 | A | | 6/1982 | Matsui |
| 4,585,240 | A | | 4/1986 | Giffin |
| 4,689,001 | A | | 8/1987 | Yoder |
| 5,180,174 | A | | 1/1993 | Province |
| 5,711,196 | A | | 1/1998 | Reid et al. |
| 5,783,123 | A | | 7/1998 | Edwards et al. |

* cited by examiner

*Primary Examiner*—Robert B. Davis
(74) *Attorney, Agent, or Firm*—Caracappa and Associates; David N. Caracappa

(57) ABSTRACT

A system for removably mounting an accessory on a pottery wheel. The system includes a locating pin which is attached to the pottery wheel at a nominal location. The location of the locating pin may be adjusted. The system also includes a hole fabricated in an accessory at a location corresponding to the nominal location. The location of the locating pin is adjusted to align with the location of the hole and the hole is slid onto the locating pin, thereby mounting the accessory on the pottery wheel.

98 Claims, 9 Drawing Sheets

APPARATUS AND METHOD FOR MOUNTING ACCESSORIES TO POTTERY WHEELS

FIELD OF THE INVENTION

The present invention relates to pottery wheel accessories, and more specifically to a method and apparatus for mounting such accessories to pottery wheels.

BACKGROUND OF THE INVENTION

Potters often use pottery wheels to make the pottery. Wheel made pottery requires the clay to be centered on the rotating wheel before the pottery can be formed into a particular shape. After the piece of pottery is made, the piece must be recentered for trimming, final shaping, and decorating. To facilitate productivity, attachments are often used. The attachments include bats, trimming apparatuses, and fixtures to hold the pottery during fabrication, trimming, shaping and decorating.

Currently, there are a variety of mechanical methods used to mount these attachments on a pottery wheel, also called a wheel head. Two of the most common are ¼-20 hex-head screws that are mounted into ¼ inch holes drilled nominally at standard locations in the pottery wheel, and ears that clamp to the sides of the pottery wheels. Unfortunately wheel manufacturers do not precisely locate the holes in the same location, nor do they machine the wheel heads to precisely the same diameter. Also, there are multiple wheel manufacturers with varying tolerances and multiple methods for mounting the wheel head to the axle around which it rotates. Each accessory must, therefore, be adjusted by a potter to fit each wheel in a pottery studio on which it is used. This essentially limits the use of bats and trimming accessories to exclusive use on one wheel. Thus, for both methods, the attachments are only applicable to a one wheel head due to the variation in the hole location, the wheel head diameter from wheel head to wheel head, and manufacturing variations.

Because the holes in the wheel head may not be located precisely and the edge of the wheel head may not be concentric with the rotating axis, accessories cannot recenter the work piece without some method to adjust the location of the accessory to compensate for the variations in the location of the holes or the edge of the wheel head. Attachment manufacturers initially used holes drilled into the accessories at the approximate location of the holes in the wheel head. The holes were then aligned with the heads of the bolts mounted on the pottery wheel. One hole was made substantially oval-shaped to accommodate the variation in the hole location.

Often the work takes longer than one session and/or when completed needs to remain undisturbed until it dries. In such a situation, it is advantageous to be able to remove the completed or partially completed work from the wheel so that wheel may be used for other work. In such situations accessories called bats may be used. Bats are flat round trays, usually the size of the pottery wheel, which may be removed from, and remounted on, the pottery wheel. To use such a bat, the pottery wheel may have holes drilled nominally at predetermined locations. Locating pins are mounted in the holes. The bat has holes at locations corresponding to those of the locating pins on the pottery wheel. Before beginning work which will require several sessions, the potter mounts the bat on the pottery wheel. The locating pins hold the bat on the pottery wheel. The work is then performed on top of the bat. When the session is over, the bat, with the completed or partially completed work-piece on it, is lifted off the wheel. The wheel, thus, becomes available for different work.

Bats made from non-porous material, e.g. plastic or masonite bats, are currently available. To use these bats, the pottery wheel has holes drilled at points nominally along a diameter at a radius of, for example, 5 inches. Bolts having a specified head size, e.g. ¼-20 hex-head bolts, are commonly mounted in the holes. The non-porous bat has holes in it, at nominal locations corresponding to the locations of the bolts: i.e. also along a diameter and at a radius of 5 inches. The size of these holes is slightly larger than the size of the bolt heads. In a specific non-porous bat, one hole is round while the other is oval-shaped. The bat, thus, may be mounted on and removed from the pottery wheel as work on the work-piece progresses. Because the holes in the pottery wheel are not precisely at the nominal locations, the remounted non-porous bat may not be at precisely the same location on the pottery wheel and, thus, may not be centered. This is especially true if the non-porous bat is mounted on a different pottery wheel.

Porous bats, such as those made from plaster, provide advantages that non-porous bats do not. For example, a work-piece on a non-porous bat will begin to dry from the outside surfaces, except the surface on the non-porous bat. This leads to uneven drying. A porous bat, on the other hand, absorbs water so all surfaces of the work-piece, including that against the bat, will dry allowing the work-piece to dry more evenly. Also, because the porous bat absorbs the moisture, the potter will be able to release the work-piece from the bat without having to cut it off with a wire.

Plaster bats, more specifically, are easy and economical to fabricate, and a potter may make as many plaster bats as needed by constructing a dam around the edge of the pottery wheel, e.g. by using wide tape or clay. The resulting volume is filled with plaster. When the plaster sets, the dam is removed and the bat may be used. The bat may be attached to the pottery wheel using clay as an adhesive between the top of the pottery wheel and the bottom of the bat. This requires that the bat be recentered manually whenever it is remounted on the pottery wheel.

Some attempts have been made to allow a plaster bat to use the same attachment mechanism as described above with respect to the non-porous bats. For example, as described above, bolts may be mounted in holes drilled in the pottery wheel, then the plaster for the bat poured. When the plaster has set, it will fit atop the bolts and not require clay as an adhesive or manual recentering. Bats are also made commercially in this manner, sometimes using rubber grommets. However, because the holes in the pottery wheel are not located precisely, a commercially produced bat may not fit onto the bolts in the pottery wheel.

This solution also may not work if there is more than one pottery wheel on which the bat may be placed. Although manufacturers of pottery wheels may drill the holes in the pottery wheel, it is often the case that potters drill the holes in their own wheels. Further, even when the manufacturer drills the holes, they are not drilled with precision. In either case, the locations of the holes may vary relatively widely from one pottery wheel to another. This is not a problem with non-porous bats because, as described above, they are manufactured with one round hole and one oval-shaped hole.

However, as described above, plaster bats may be fabricated directly on the pottery wheel, or commercially with rubber grommets. If the locating pins on a pottery wheel do not align precisely with the corresponding holes in the bat, the bat does not fit on that pottery wheel. Even if the bat fits on the pottery wheel, the holes in this pottery wheel may not be in the same relative locations with respect to the center of the original pottery wheel, thus, the bat may not be centered on the new pottery wheel. In addition, plaster is soft and brittle. Repeatedly removing and remounting a plaster bat made as described above on a pottery wheel, even the pottery wheel on which is was originally fabricated, eventually leads to the bolt heads scraping the holes in the bat, making them larger and allowing the bat to slip on the pottery wheel.

BRIEF SUMMARY OF THE INVENTION

The inventor has realized that a method and apparatus is desired which may be used to locate multiple accessories on wheel heads and permit such accessories to be used on multiple wheel heads without the necessity to make "centering" adjustments to the accessory each time it is used on a different wheel head. More specifically, the inventor has realized that such a method and apparatus would permit plaster bats to be easily mounted and used on multiple wheel heads while maintaining the clay in the center of the wheel head with respect to the center of rotation. The inventor has also realized that a method and apparatus is desired which may be used to fabricate and mount plaster bats on a plurality of different pottery wheels, and which will not result in damage to the plaster bat from repeated removal and remounting on the plurality of pottery wheels.

In accordance with principles of the present invention, a system for removably mounting an accessory on a pottery wheel includes a locating pin which is attached to the pottery wheel at a nominal location. The location of the locating pin may be adjusted. The system also includes a hole fabricated in the accessory at a location corresponding to the nominal location. The location of the locating pin is adjusted to align with the location of the hole and the hole is slid onto the locating pin, thereby mounting the accessory on the pottery wheel.

DETAILED DESCRIPTION OF THE INVENTION

Figure 1:
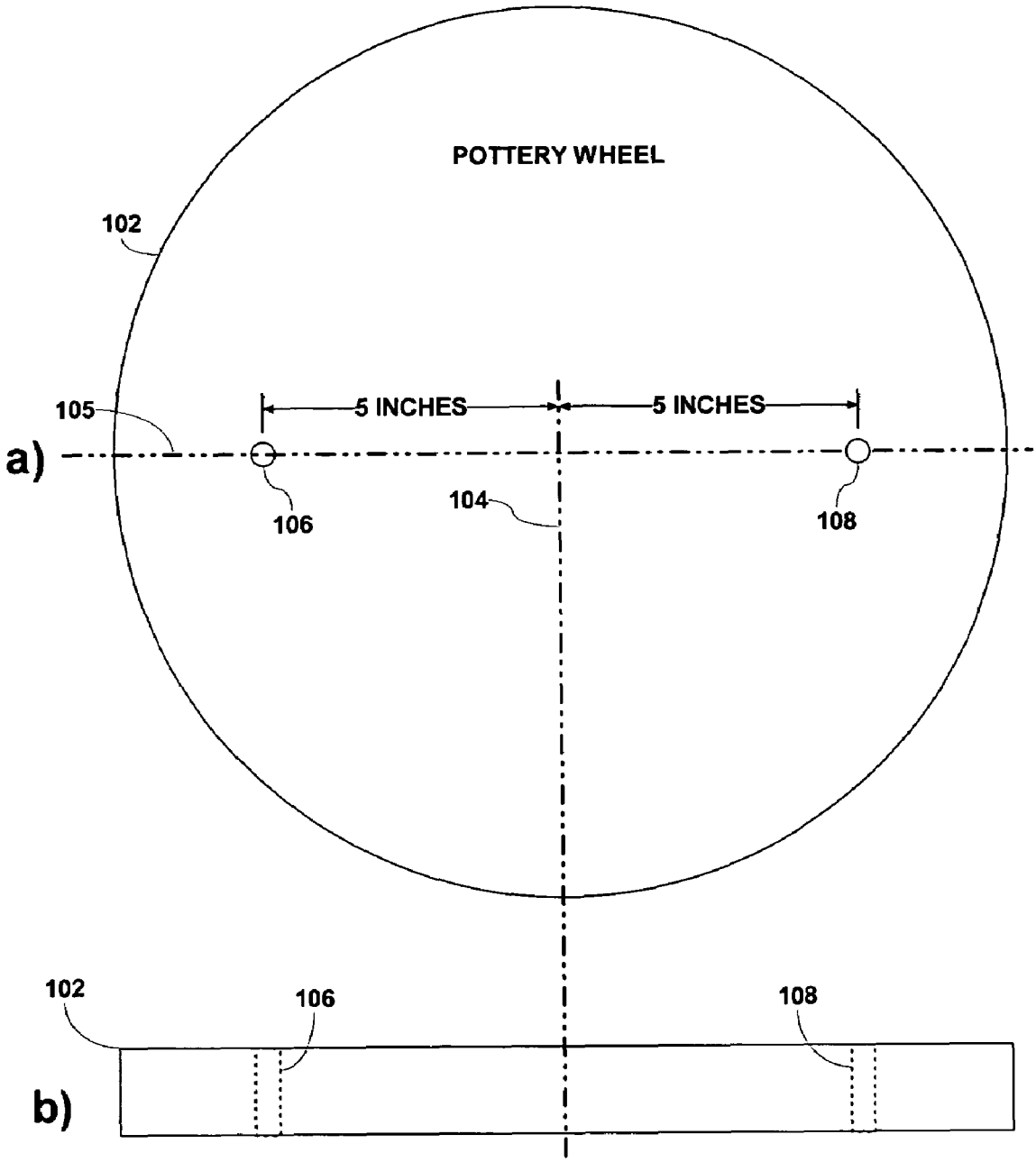
FIG. 1 is a diagram of a pottery wheel in which holes have been drilled for locating pins.

FIG. 1 is a diagram of a pottery wheel in which holes have been drilled for locating pins at nominal locations. FIG. 1*a* illustrates a top view of a pottery wheel 102 and FIG. 1*b* illustrates a side view of the pottery wheel 102. Two holes, 106 and 108 are drilled through the pottery wheel 102 nominally along a diameter 105 and at respective radii of 5 inches. As described above, the holes 106 and 108 are generally drilled by the pottery wheel manufacturer but sometimes are drilled by the owner of the pottery wheel. Thus, while the holes are nominally at 5 inch radii along a diameter, there may be a relatively wide tolerance around that nominal location.

Figure 2:
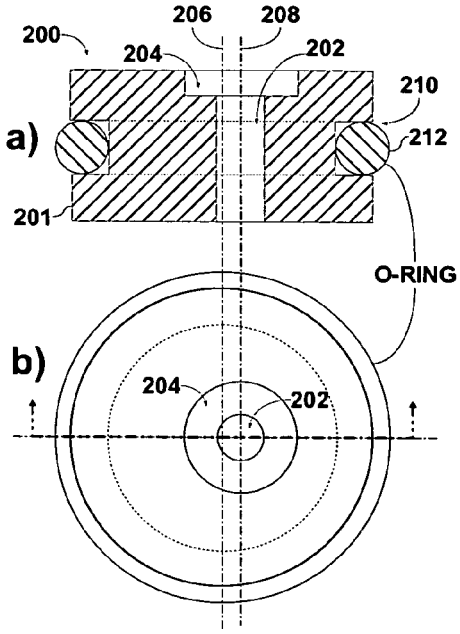
FIG. 2 is a diagram of a locating pin according to principles of the present invention.

FIG. 2 is a diagram of an embodiment of a locating pin 200 according to principles of the present invention. FIG. 2*a* illustrates a cut-away side view of the locating pin 200, and FIG. 2*b* illustrates a top view of a locating pin 200. The locating pin 200 includes a solid body 201 in the form of a circular cylinder and is fabricated to form a hole 202. The body 201 is preferably an abrasion resistant material, for example aluminum or hard plastic. The centerline of the locating pin 200 is illustrated as 206. The centerline of the hole 202 formed in the body 201 is illustrated as 208, and is offset from the centerline 206 of the locating pin 200.

Figure 3:
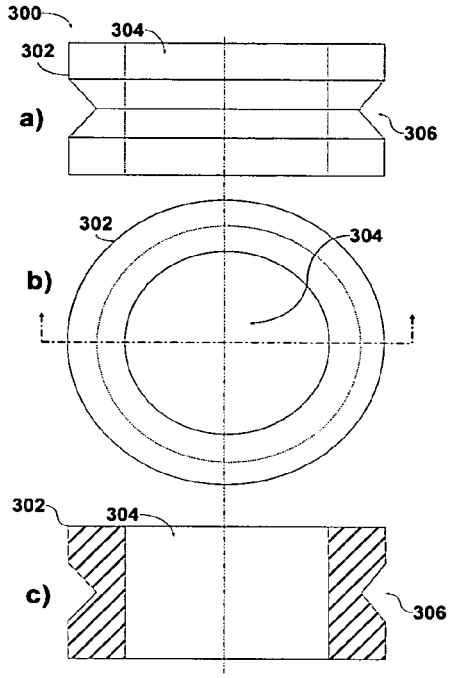
FIG. 3 is a diagram of a collar adapted to operate with the locating pin illustrated in FIG. 2.
Figure 4:
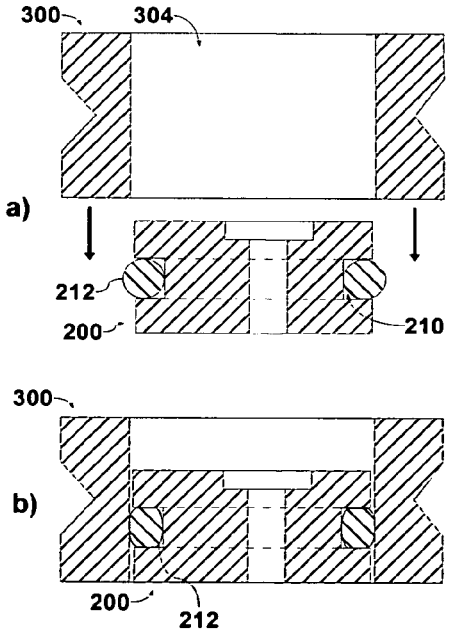
FIG. 4 is a diagram illustrating how the collar of FIG. 3 may be mounted on the locating pin of FIG. 1.

FIG. 3 is a diagram of a collar 300 adapted to operate with the locating pin 200 illustrated in FIG. 2. FIG. 3*a* is a side view of a collar, FIG. 3*b* is a top view of the collar and FIG. 3*c* is a cut-away side view of the collar. The collar 300 is also preferably an abrasion resistant material such as aluminum or hard plastic. The collar includes a solid body 302 which is generally annular forming a hole 304. The hole 304 is sized to fit over the locating pin 200 illustrated in FIG. 2. FIG. 4 is a diagram of cut-away views of the locating pin 200 (of FIG. 2) and the collar 300 (of FIG. 3) illustrating how the collar 300 may be mounted on the locating pin 200. In FIG. 4*a*, the hole 304 formed in the collar 300 is aligned with the locating pin 200. The collar 300 is slid onto the locating pin 200, as illustrated by the arrows. FIG. 4*b* illustrates the collar 300 after it is slid onto the locating pin 200. The collar illustrated in FIG. 3 includes a notch 306 formed in the periphery of the collar 302.

Figure 5:
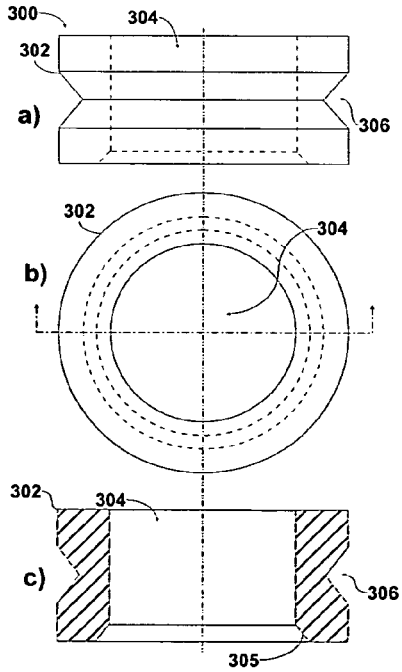
FIG. 5, FIG. 6 and FIG. 7 are diagrams of alternate embodiments of a collar adapted to operate with the locating pin illustrated in FIG. 2 as illustrated in FIG. 4.
Figure 6:
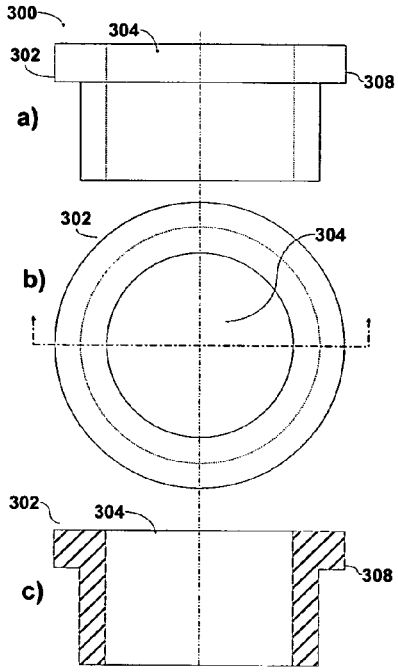
Figure 7:
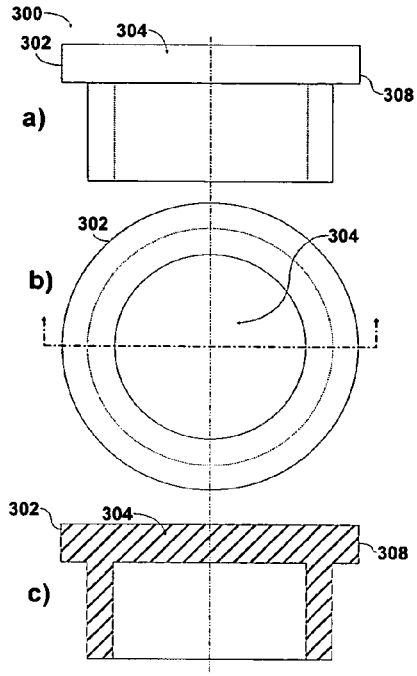

FIG. 5 is a diagram of an alternate embodiment of a collar 300. In FIG. 5, a bevel 305 is formed at one end of the hole 304. The bevel 305 makes it easier to slide the collar 300 over the locating pin 200. The remainder of the collar 300 of FIG. 5 is identical to that illustrated in FIG. 3. FIG. 6 is a diagram of another alternate embodiment of a collar 300. In FIG. 6, instead of a notch 306, the collar 302 includes a flange 308. In FIG. 6, the hole 304 goes completely through the collar 302. The remainder of the collar 300 illustrated in FIG. 6 is identical to that illustrated in FIG. 3. FIG. 7 is a diagram of another alternate embodiment of a collar 300. As illustrated in FIG. 6, the collar 300 illustrated in FIG. 7 includes a flange 308. In this case, the hole 304 is open only at the bottom, and is closed at the top. The remainder of the collar 300 of FIG. 7 is identical to that illustrated in FIG. 3. It is further possible for the collars illustrated in FIG. 6 and FIG. 7 to include a bevel, such as the bevel 305 illustrated in FIG. 5 to make it easier to slide the collar 300 over the locating pin 200.

In the embodiment of the locating pin 200 illustrated in FIG. 2, and FIG. 4 a notch 210 is formed around the periphery of the locating pin 200. The notch 210 is adapted to receive an o-ring 212. The notch 210 is fabricated and the o-ring 212 is selected so that the o-ring 212 protrudes from the side of the locating pin 200. FIG. 4*b* illustrates that the o-ring 212 becomes compressed when the collar 300 is slid onto the locating pin 200. This allows the collar to be more firmly seated on the locating pin 200. The o-ring 212, and the notch 210 in which is sits, are not required, however, and may be omitted from the locating pin 200.

Figure 8:
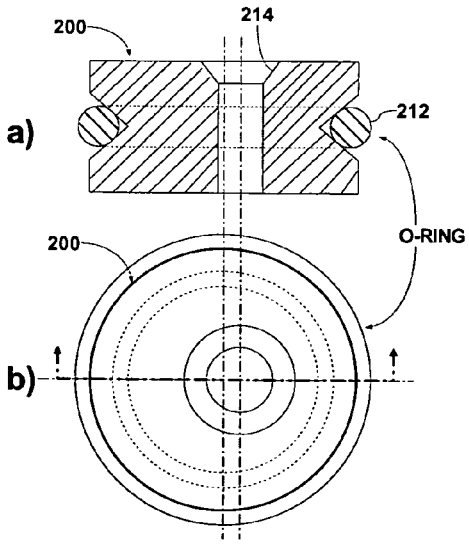
FIG. 8, FIG. 9, FIG. 10, and FIG. 11 are diagrams of alternate embodiments of locating pins.

In addition, as will be described in more detail below, the locating pin 200 may be attached to the pottery wheel 102 (FIG. 1) at the locations of the holes 106 and 108 by a screw or bolt, such as a round head screw, and e.g. a wing nut or other such attachment means inserted through the hole 202. Referring again to FIG. 2, if it is desired to prevent the head of the screw or bolt from protruding from the top of the locating pin 200, the locating pin 200 may be fabricated to form a countersink 204. When mounted on the pottery wheel 102, the head of the screw or bolt is recessed into the countersink 204, and will not protrude above the top of the locating pin 200. An alternative embodiment of a locating pin 200 is illustrated in FIG. 8. In this embodiment, a flat-head screw (not shown) is used to attach the locating pin 200 to the pottery wheel 102. To prevent the head of the screw 502 from protruding above the top of the locating pin 200, a conical bevel 214 is formed in the locating pin 200. The remainder of the locating pin 200 is as described above with respect to FIG. 2. Neither the countersink 204 nor the bevel 214 are required, however, and may be omitted from the locating pin 200.

Figure 9:
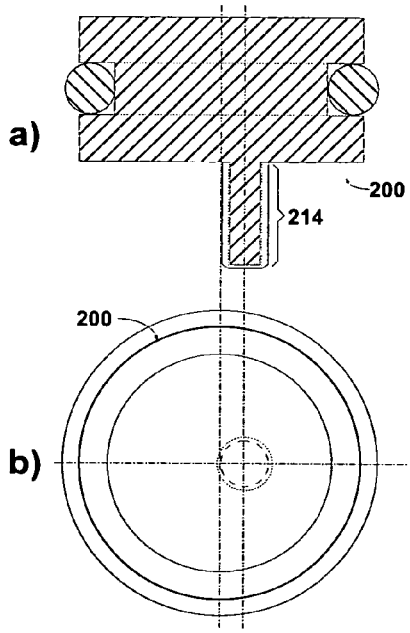

FIG. 9 is another embodiment of a locating pin 200. The locating pin 200 in FIG. 9 is a unit including an integrated attachment mechanism, instead of requiring a screw or bolt or other attachment mechanism to be mounted on the pottery wheel 102. Instead of a hole 202 (and corresponding countersinks 204 or 214) the body 201 is solid and includes a circular cylindrical extension 214, which is threaded, e.g. with ¼-20 threads. The remainder of the locating pin 200 is the same as that illustrated in FIG. 2. The extension 214 may be inserted into a hole (106, 108) in the pottery wheel 102 and is sufficiently long that the locating pin 200 may be secured with a nut, e.g. a wing nut.

Figure 10:
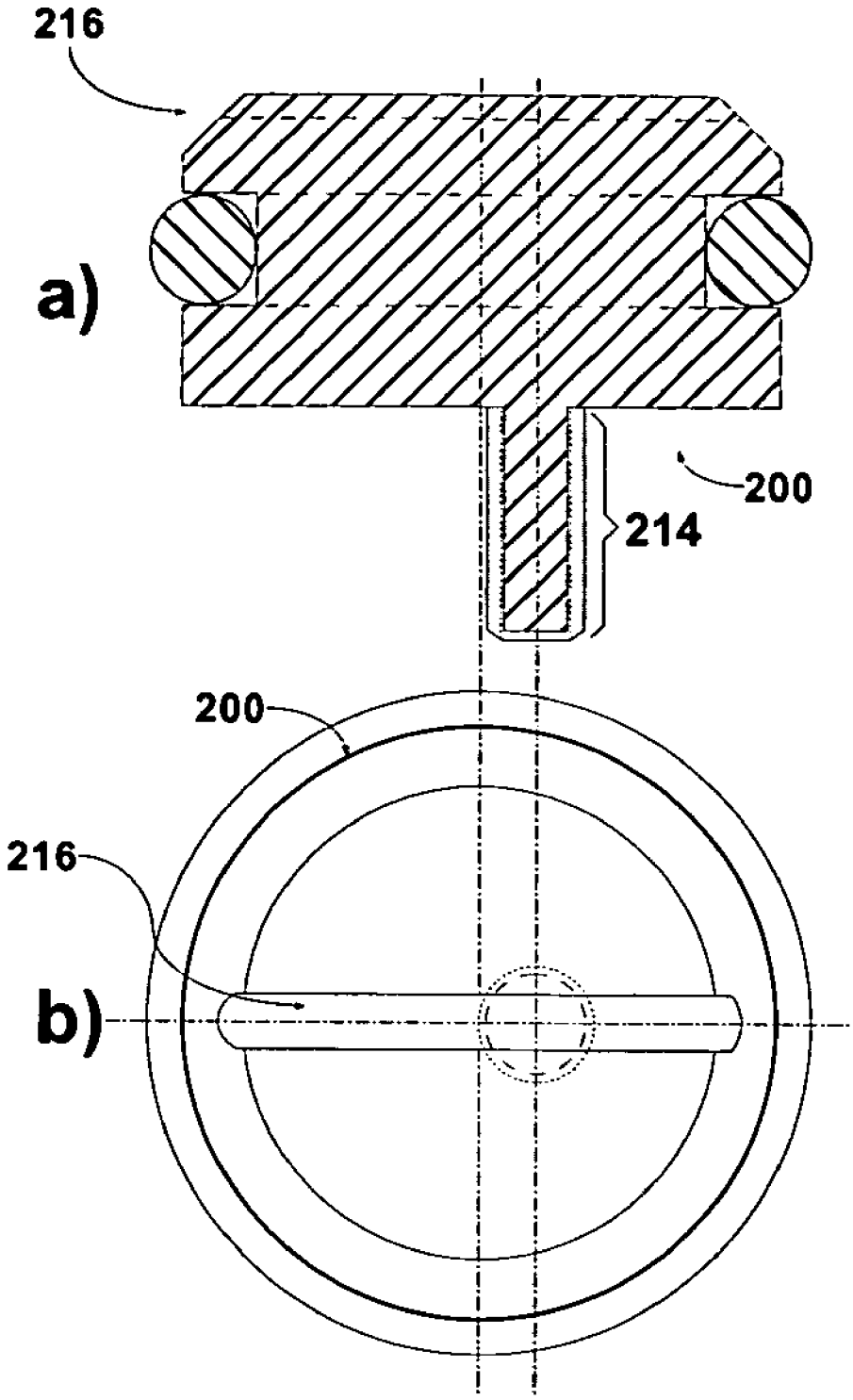

FIG. 10 is another embodiment of a locating pin 200. The locating pin 200 in FIG. 10 is also unitary, as is the embodiment illustrated in FIG. 9, including a threaded extension 214. The locating pin in FIG. 10 also includes a bevel 216 around the upper edge. This permits the collar 300 (FIG. 3) to be slipped over the locating pin 200 more easily. The locating pin 200 of FIG. 10 also includes a screwdriver slot 216 on the top. This permits more secure attachment to the pottery wheel 102 (of FIG. 1) and easier adjustment of the location of the locating pin 200. Although illustrated as a slot, screwdriver slot 216, it could also be a Phillips head, Allen head, square drive or any other common screwdriver format.

Figure 11:
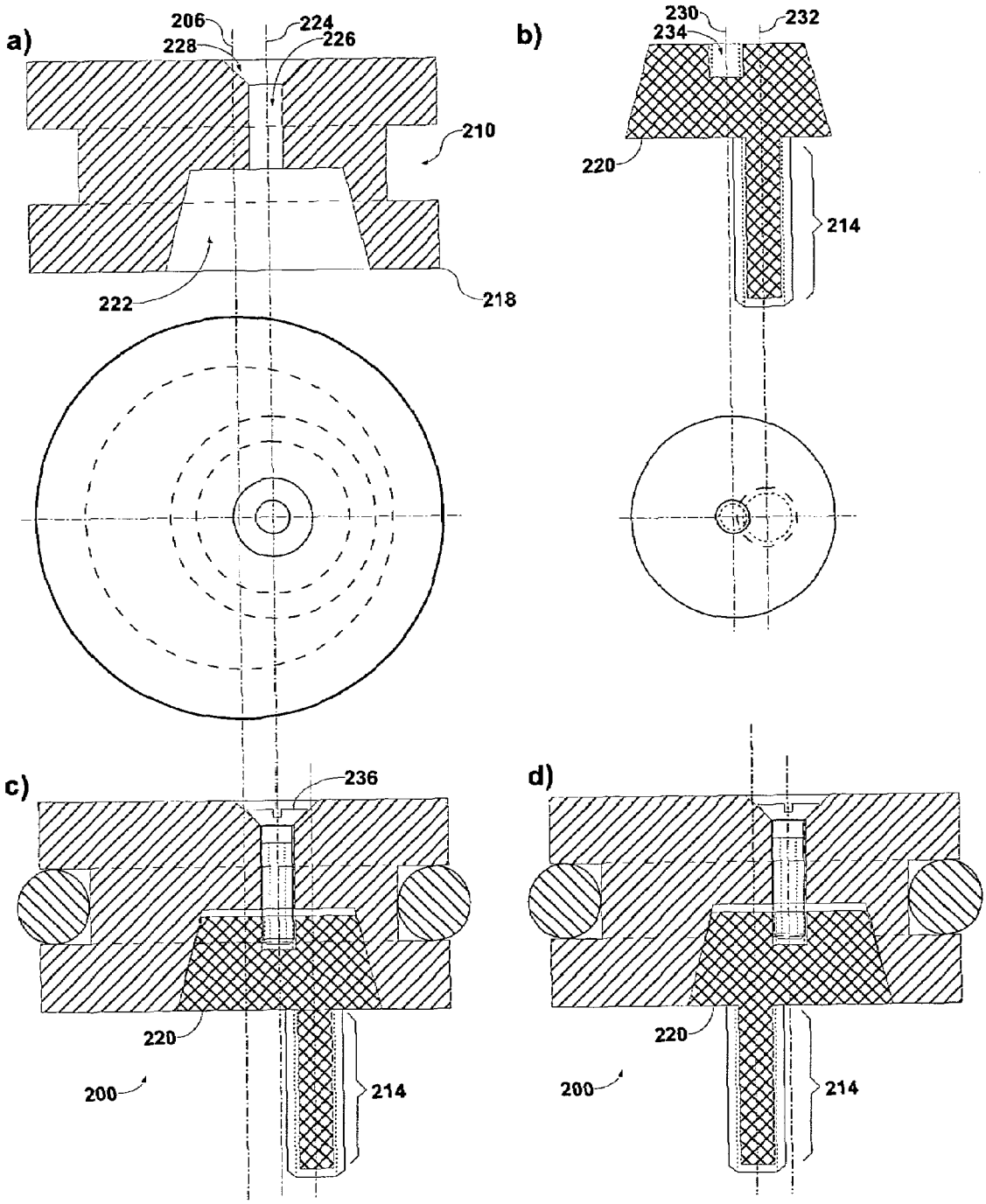

FIG. 11 is a diagram of another embodiment of a locating pin 200. In FIG. 11, the offset between the centerline of the locating pin 200 and the attachment point may be adjusted. The locating pin 200 of FIG. 11 comprises two parts: a main body 218, illustrated in FIG. 11*a*, and an insert 220, illustrated in FIG. 11*b*. Referring to FIG. 11*a*, the main body 218 resembles the locating pins 200 illustrated in FIG. 2, FIG. 4, FIG. 8, FIG. 9 and FIG. 10. That is, it is a circular cylinder with a notch 210 around the periphery formed to receive an o-ring. The main body 218 is fabricated to form an opening 222 in the bottom which is frustrum shaped. The centerline of the main body 218 is illustrated on FIG. 11 as 206. The centerline of the frustrum-shaped opening 222 is illustrated as 224. The main body 218 also is fabricated to form a hole 226 along the centerline of the frustrum-shaped opening 222. A bevel 228, for a flat-head machine screw in the illustrated embodiment, is also formed in the main body 218. The rest of the main body 218 is similar to the locating pins illustrated in FIG. 2, FIG. 4, FIG. 8, FIG. 9 and FIG. 10.

Referring to FIG. 11*b*, the insert 220 is fabricated as a frustrum adapted to fit in the frustrum-shaped opening 222 in the main body 218, and includes a threaded extension 214, similar to those illustrated in FIG. 2, FIG. 4, FIG. 8, FIG. 9 and FIG. 10. The centerline of the insert 220 is illustrated as 230 and the centerline of the threaded extension is illustrated as 232. On the top of the insert 220, on the centerline of the insert 220, a hole 234 is drilled and tapped, producing internal threads.

FIG. 11*c* is a diagram illustrating how the main body 218 of FIG. 11*a* is assembled with the insert 220 of FIG. 11*b*. The frustrum-shaped insert 220 is inserted into the frustrum-shaped opening 222 in the main body 218. The frustrum-shaped opening 222 in the main body 218 and the insert 220 are sized such that when assembled the bottom of the main body 218 is substantially level with the bottom of the insert 220. Further, the insert 220 is able to rotate with respect to the main body 218 within the frustrum-shaped opening 222. When assembled in this manner, the centerline 230 of the insert 220 aligns with the centerline 224 of the hole 226. A flat head screw 236 is inserted through the hole 226 in the main body 218 and screwed into the threaded hole 234 in the insert 220. While the screw 236 is loose, the insert 220 may be rotated within the frustrum-shaped opening 222. When the screw 236 is tightened, the outside wall of the insert 220 is pulled into contact with the inside wall of the frustrum-shaped opening 222 and is held in place. In this manner, the offset of the extension 214 from the centerline 206 of the locating pin 200 may be adjusted for proper centering of the plaster bat.

FIG. 11*c* illustrates the insert 220 rotated so that the extension 214 is on the right side. In this position, the extension 214 is at its maximum offset from the centerline 206 of the main body 218. FIG. 11*d* illustrates the insert 220 rotated so that the extension 214 is on the left side. In this position, the extension 214 is at its minimum offset from the centerline 206 of the main body 218. In the illustrated embodiment, the offset between the centerline 230 of the insert 220 and the centerline 232 of the extension 214 is substantially equal to the offset between the centerline 206 of the main body 218 and the centerline 224 of the frustrum-shaped opening 222, and therefore of the insert 220 when placed within it. Thus, when rotated to the left, the centerline of the extension 214 aligns with the centerline of the main body 218. This is not necessary, however, and the respective offsets may be fabricated as desired.

Figure 12:
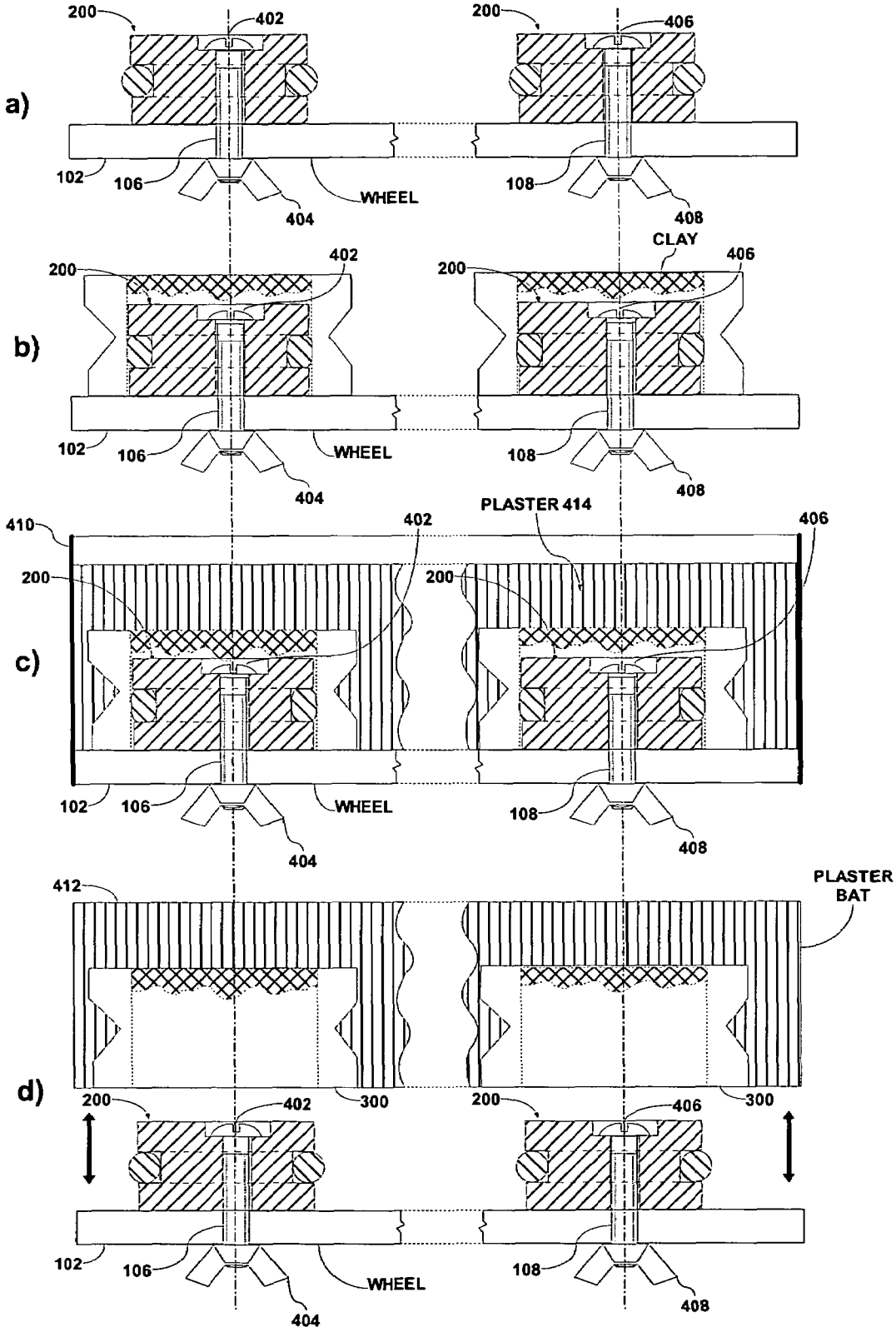
FIG. 12 is a diagram illustrating the use of the locating pin illustrated in FIG. 2 and the collar illustrated in FIG. 3 to make a plaster bat using a pottery wheel as illustrated in FIG. 1 according to the present invention.

FIG. 12 is a diagram illustrating the use of the locating pin 200 illustrated in FIG. 2 and the collar 300 illustrated in FIG. 3 to make a plaster bat using a pottery wheel as illustrated in FIG. 1. Any of the other embodiments of a locating pin 200 (FIG. 8, FIG. 9, FIG. 10, FIG. 11) and/or the collar 300 (FIG. 5, FIG. 6, FIG. 7) may be used in the manner described below and illustrated in FIG. 12. The first step is illustrated in FIG. 12*a*. Two locating pins 200 are attached to the pottery wheel 102 using respective screws 402 and 406 and corresponding wing nuts 404 and 408. Referring for a moment to FIG. 1, both locating pins 200 are bolted into their respective holes 106 and 108 at their respective nominal locations. In FIG. 12*b*, respective collars 300 (FIG. 3) are slid over the two locating pins 200. For the embodiments of the collar including an open hole 304 (FIG. 3, FIG. 5, FIG. 6), a bit of clay, illustrated by double-crosshatching, is placed in the open end of the collars 300. This prevents plaster from entering the opening of the collars 300, as may be seen in more detail below. A potter will understand that any material which is impervious to plaster may be used instead of clay, though clay will be readily available to a potter. For the embodiment of the collar 300 with a closed hole 304 (FIG. 7) this is not necessary.

In FIG. 12*c*, the plaster bat 412 is formed. First a dam 410 is formed around the outside edge of the pottery wheel 102. This may be formed by using tape, in a known manner. This dam 410 forms the sides of a well for which the pottery wheel is the bottom. The locating pins 200 and collars 300 (with clay in the open end, if necessary) are bolted to the bottom of the pottery wheel 102. Plaster 414 of an appropriate consistency is poured into this well to a desired depth and allowed to set. In FIG. 12*d*, the plaster has set. The dam 410 is removed, and the plaster bat 412 removed from the pottery wheel 102. As may be seen, the collars 300 remain embedded in the plaster bat 412, while the locating pins 200 remain bolted to the pottery wheel 102. In the illustrated embodiments, the collars 300 include means for being retained in the plaster bat 412. Referring to the collars 300 illustrated in FIG. 3 and FIG. 5, the plaster 414 forms in the notch 306 and prevents the collar 300 from slipping out of the plaster bat 412 when it is removed from the pottery wheel 102. Referring to the collars 300 illustrated in FIG. 6 and FIG. 7, the plaster 414 forms around the flange 308 and prevents the collar 300 from slipping out of the plaster bat 412 when it removed from the pottery wheel 102.

Figure 13:
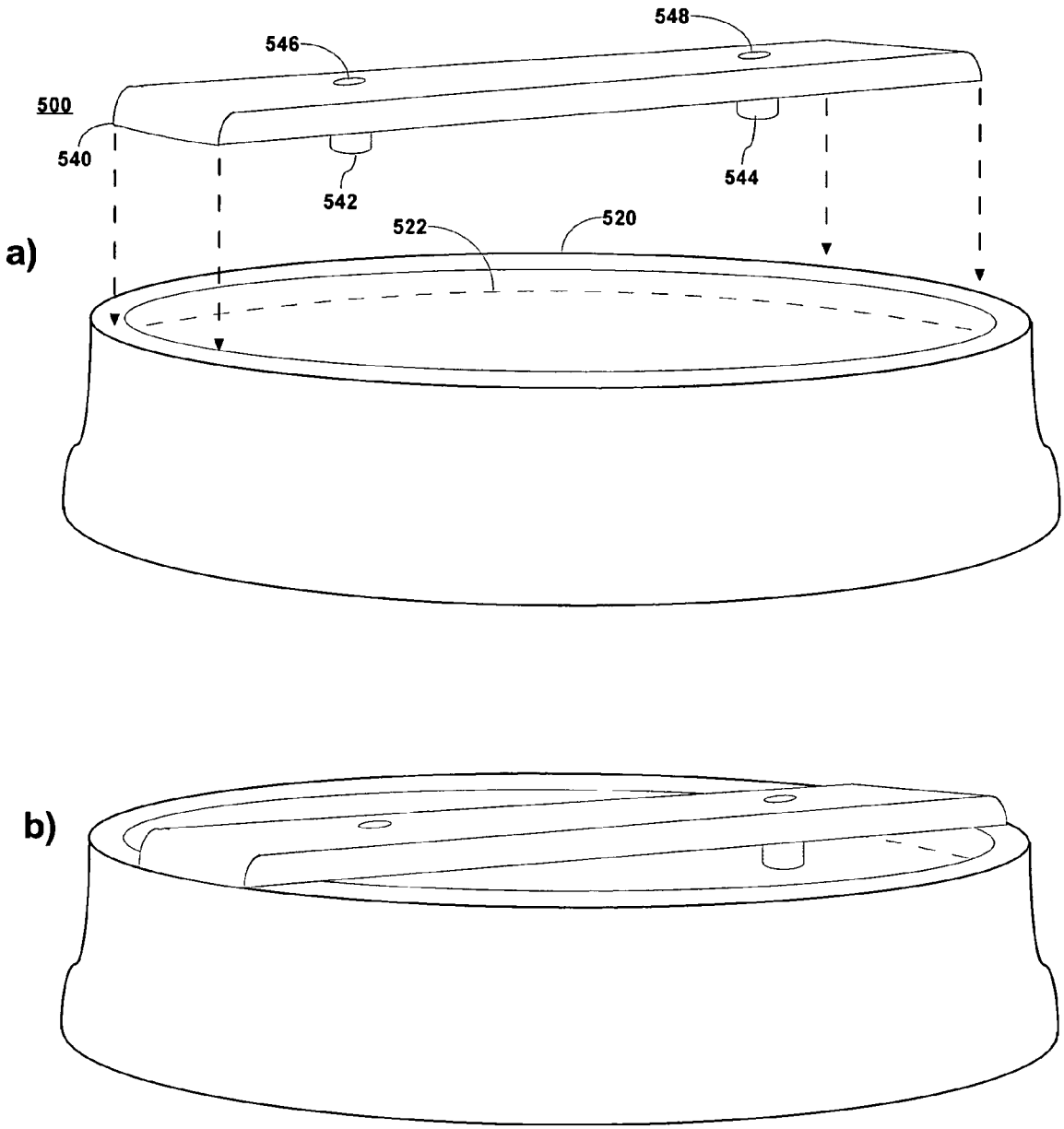
FIG. 13 and FIG. 14 are diagrams illustrating an alternative method and apparatus for making a plaster bat according to the present invention.
Figure 14:
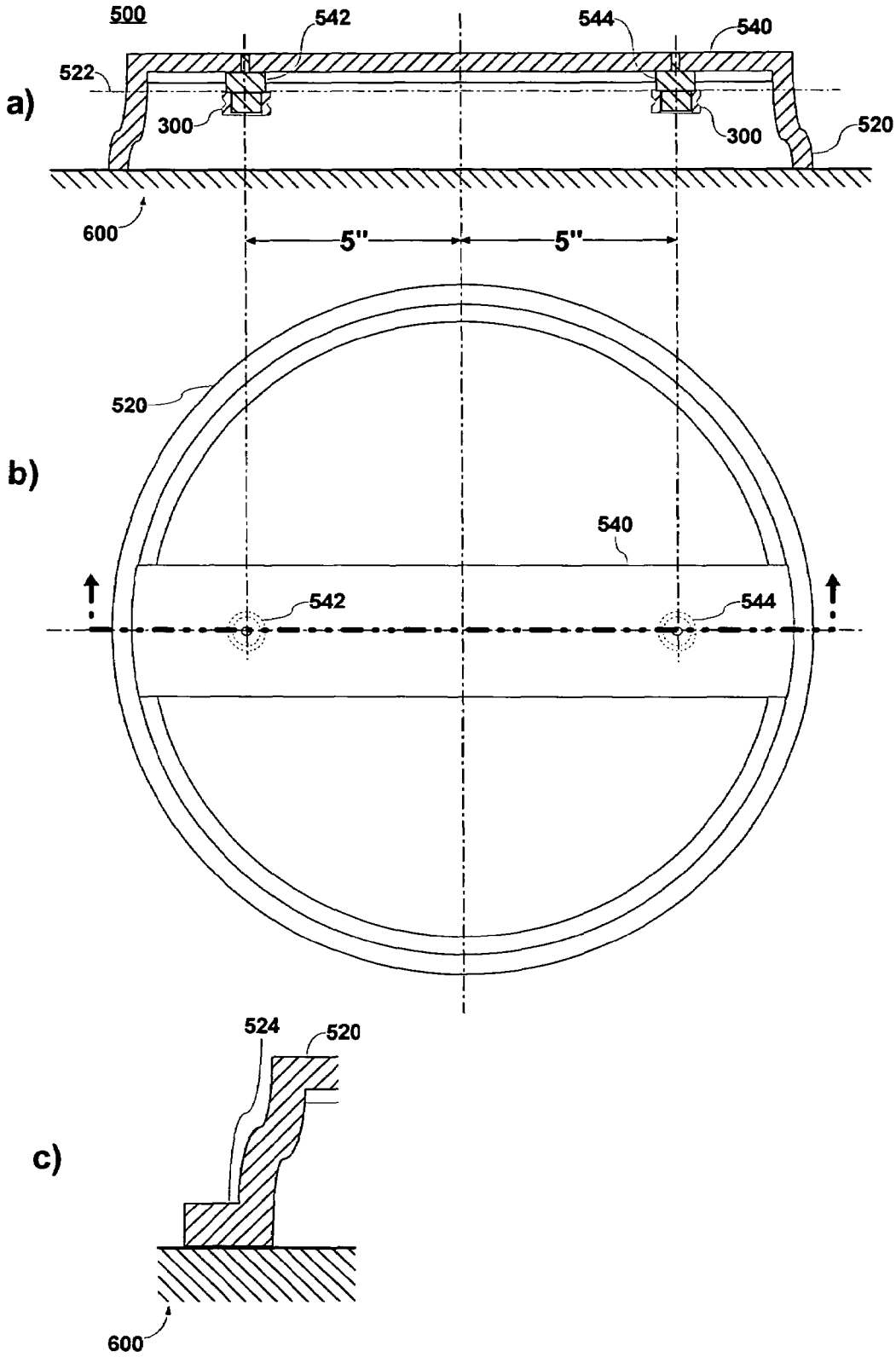

An alternative method and apparatus for fabricating plaster bats according to the present invention is illustrated in FIG. 13 and FIG. 14. FIG. 13 is an isometric drawing and FIG. 14 is an orthographic drawing of a mold 500 for making plaster bats including collars 300 (as illustrated in FIG. 3). The mold 500 of FIG. 13 consists of two portions: a well portion 520 and a bridge portion 540. The well portion 520 is substantially cylindrical and is open at the bottom and top. The bridge portion 540 is shaped to fit across the top of the well portion 520. FIG. 13*a* illustrates these two portions separately, and illustrates the location of the bridge portion 540 on the well portion 520 by arrows. FIG. 13*a* is intended only to separately illustrate the well portion 520 and the bridge portion 540, and not to represent any assembly technique. The well portion 520 and the bridge portion may be fabricated separately and bonded together, however, the mold 500 is preferably fabricated as a single unitary piece from e.g. ABS plastic. FIG. 13*b* illustrates the mold 500 as assembled or as fabricated as a unitary piece.

The bridge portion 540 includes two collar holders 542 and 544. The collar holders 542 and 544 are each fabricated so that a collar 300, as illustrated in FIG. 3 and/or FIG. 5 may be slid onto them. The collar holders 542 and 544 are illustrated as being mounted in respective holes 546 and 548. However, any method of placing a collar holder on the bridge portion 540 may be used, including adhesives, spin welding, or molding the collar holders 542 and 544 as a unitary part of the bridge portion 540 or the mold 500 as a unitary piece.

Referring now to FIG. 14, FIG. 14*a* illustrates a cut-away side view of the mold 500 and FIG. 14*b* illustrates a top view of the mold 500. In FIG. 14*a*, the mold 500 is placed on a relatively hard smooth surface 600. The well portion 520 is placed against the surface 600 with the bridge portion 540 at the top. The collar holders 542 and 544 project downward. As illustrated in FIG. 14*b*, the collar holders 542 and 544 are placed at five inch radii along a center line of the bat. Respective collars 300, as illustrated in FIG. 3, FIG. 5, FIG. 6 and/or FIG. 7, are illustrated slipped onto the collar holders 542 and 544. A fill-line 522 is established at the top of the collars 300. Referring back to FIG. 13*a*, this fill-line 522 is also displayed on the inside wall of the well portion 520 for the potter to see. FIG. 14*c* is a more detailed diagram of another embodiment of the mold 500. FIG. 14*c* is a cut-away view of a wall of the well portion 520. At the bottom of the well portion 520, along the bottom surface which is placed on the smooth hard surface 600 is a flange 524. This flange runs around the complete circumference of the well portion 520. The flange 524 provides a top surface area which allows a clamp to be used to hold the mold 500 tightly to the smooth hard surface.

Figure 15:
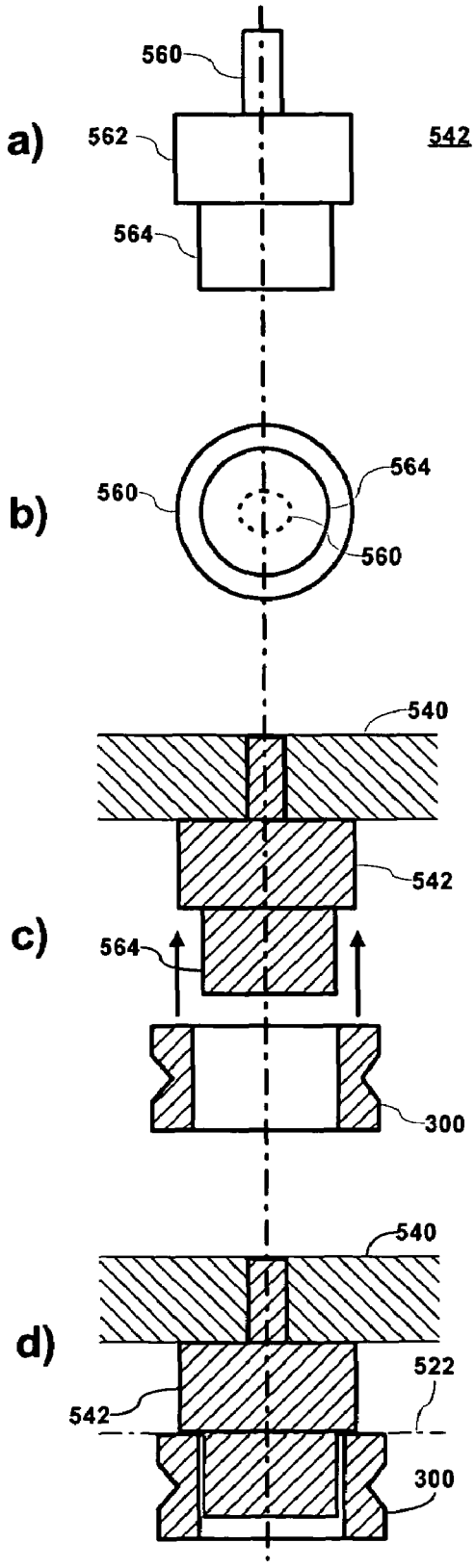
FIG. 15 is a more detailed diagram illustrating a portion of the apparatus illustrated in FIGS. 13 and 14 for making a plaster bat according to the present invention.

FIG. 15 is a more detailed illustration of an embodiment of a collar holder 542. FIG. 15*a* is a side view of a collar holder 542 and FIG. 15*b* is a view from the bottom. The collar holder 542 has an insert portion 560, a main body 562 and a locating pin portion 564. The insert portion 560 is fabricated to fit into the holes 546 and 548 in the bridge portion 540 of the mold 500 (FIG. 13). As described above, the insert portion 560 may be attached to the bridge portion 540 using adhesives, spin welding, or any other such attachment mechanism, or may be molded as a part of the bridge portion 540. The locating pin portion 564 is adapted to receive the collar 300. Although not illustrated in FIG. 15, the locating pin portion 564 may include a notch and associated O-ring to hold the collar 300 more securely, as described above and illustrated in FIG. 2, FIG. 8, FIG. 9, FIG. 10, and FIG. 11. FIG. 15*c* is a cutaway diagram which shows the collar holder 542 mounted in the bridge portion 540. A collar 300 is slid into place on the locating pin portion 564 as indicated by the arrows. FIG. 15*d* shows the collar 300 in place on the collar holder 542.

To make a plaster bat using the mold 500 illustrated in FIG. 13 and FIG. 14, collars 300 are slipped on the collar holders 542 and 544 (FIG. 15), and the mold 500 is placed upon a smooth hard surface. If the mold 500 includes a flange, as illustrated in FIG. 14*c*, the mold may be clamped to the smooth hard surface. Then plaster is prepared of the appropriate consistency and poured into the well portion 520 up to the fill line 522. When filled to the fill line 522, the plaster surrounds the collars 300. To ensure this, the main body 562 of the collar holder 542 is sized to hold the top of the collars 300 at the fill line 522. When the plaster has set, the bat is removed from the mold 500 while the collars 300 remain embedded in the plaster bat. The resulting bat is the same as the bat 412 illustrated in FIG. 12. A mold 500 as illustrated in FIG. 13 and FIG. 14 allows a potter to fabricate plaster bats without tying up a pottery wheel for the amount of time necessary for plaster to set.

When it is desired to remount the plaster bat 412 (of FIG. 12), or any other plaster bat 412 fabricated in the manners described above, on the pottery wheel 102, the wing nuts 404 and 408 are loosened to allow the locating pins 200 to rotate around the axis of the bolts 402 and 406. That is, the locations of the locating pins 200 are adjustable. The plaster bat 412 is lowered so that the collars 300 embedded in the plaster bat 412 are near the locating pins 200. The plaster bat 412 and the locations of the locating pins 200 are adjusted until the collars 300 in the plaster bat 412 are aligned with the locating pins 200. When aligned in this manner, the collars 300 in the plaster bat 412 may be slid down over the locating pins 200. Because the wing nuts have been loosened, the plaster bat 412 may be moved relative to the pottery wheel 102 to a limited extent. The plaster bat 412 is moved so that it is centered on the pottery wheel 102. Then the wing nuts 404 and 408 are tightened. Because the centers of the locating pins 200 may be moved relative to the centers of the holes 106 and 108 it is possible to mount plaster bats 412 fabricated on a different pottery wheel 102 and/or using the mold 500, even if the holes 106 and 108 are drilled in different relative locations. The limited movement after the plaster bat 412 has been mounted on the locating pins 200 allows the plaster bat 412 to be centered.

The arrangement described above allows a plaster bat 412 to be easily and economically fabricated to hold completed or partially completed work-pieces, and allows that plaster bat 412 to be used on a plurality of different pottery wheels 102 even if the mounting holes 106 and 108 are not drilled in precisely the nominal or same locations.

A kit may be formed including two locating pins 200 as illustrated in FIG. 2, FIG. 8, FIG. 9, FIG. 10, and/or FIG. 11 and two collars 300 as illustrated in FIG. 3, FIG. 5, FIG. 6, and/or FIG. 7. The kit may also include wing nuts 404 and 408. For those embodiments requiring a bolt, a kit may be formed with locating pins 200, collars 300 the two corresponding wing nuts 404 and 408 and also two bolts 402 and 406, though it is anticipated that these items would be standard sized items widely available in hardware stores or other similar locations.

Further, a kit may be formed including only two collars 300. Kits including both locating pins 200 and collars 300 allow a potter to equip all the pottery wheels 102 with locating pins 200 and fabricate one plaster bat 412 including collars 300 for each such pottery wheel 102. Kits including only collars 300 allow a potter to fabricate additional plaster bats 412. In addition, the mold 500 as illustrated in FIG. 13 and FIG. 14 may be provided with a kit including and one or more sets of two collars. This would allow a potter to fabricate additional plaster bats using the mold 500 without tying up a pottery wheel for the time necessary for plaster to set.

Although most of the description above relates to fabricating, mounting and centering a plaster bat on one or more pottery wheels, the above technique may be used to mount and center any accessory on a pottery wheel. Such an accessory is fabricated to contain holes, adapted to slide onto locating pins, at locations corresponding to the nominal locations of locating pins on a pottery wheel, e.g. on a diameter at radii of 5 inches. These holes may include some form of collar, but that is not necessary. Locating pins attached to the pottery wheel are adjusted until they align with the holes in the accessory. The holes in the accessory are then slid onto the locating pins. The location of the accessory may be adjusted until it is centered on the pottery wheel. The locating pins may then be tightened if desired. In this manner, any accessory may be easily mounted on and removed from a pottery wheel, and shared among may pottery wheels.

What is claimed is:

1. A method for removably mounting an accessory on a pottery wheel, comprising the steps of:

attaching a locating pin to a nominal location on the pottery wheel, the location of the locating pin being adjustable;

fabricating an accessory with a hole, adapted to slidably fit over the locating pin, at a location corresponding to the nominal location;

adjusting the location of the locating pin to align with the hole; and sliding the hole of the accessory on the locating pin.

2. The method of claim 1 wherein the step of fabricating the accessory comprises the step of fabricating the accessory comprising a collar, forming a hole adapted to slidably fit over the locating pin, such that the location of the hole in the collar corresponds to the nominal location.

3. A method for removably mounting an accessory on a pottery wheel, the accessory having a hole at a location corresponding to a nominal location on the pottery wheel, the hole being adapted to slidably fit over a locating pin, the method comprising the steps of:

attaching a locating pin to the nominal location on the pottery wheel, the location of the locating pin being adjustable;

adjusting the location of the locating pin to align with the location of the hole in the accessory; and sliding the hole of the accessory on the locating pin.

4. A method for fabricating an accessory adapted for use on a pottery wheel comprising a locating pin attached to a nominal location, the location of the locating pin being adjustable, comprising the steps of:

fabricating the accessory having a hole at a location corresponding to the nominal location on the pottery wheel, the hole being adapted to slidably fit over the locating pin; whereby:

the locating pin may be adjusted to align with the location of the hole in the accessory; and the hole of the accessory may be slid on the locating pin.

5. A system for removably mounting an accessory on a pottery wheel, comprising:

a locating pin, attached to the pottery wheel at a nominal location, and having an adjustable location; and an accessory comprising a hole, adapted to slidably fit over the locating pin, fabricated in the accessory at a location corresponding to the nominal location; wherein:

the locating pin is adjustable to align with the location of the collar.

6. The system of claim 5 wherein the accessory is a bat.

7. The system of claim 6 wherein the bat is a non-porous bat comprising a collar forming a hole adapted to slidably fit over the locating pin and fabricated in the non-porous bat at a location corresponding to the nominal location.

8. The system of claim 7 wherein the non-porous bat is fabricated from plaster.

9. The system of claim 7 wherein the locating pin comprises means for securely holding the collar.

10. The system of claim 9 wherein:

the locating pin comprises a notch adapted to contain an o-ring; and the system further comprises an o-ring in the notch.

11. The system of claim 7 wherein the collar comprises a means for being retained when fabricated in the non-porous bat.

12. The system of claim 11 wherein the retaining means comprises a notch formed in the periphery of the collar.

13. The system of claim 11 wherein the retaining means comprises a flange formed on the periphery of the collar.

14. The system of claim 7 wherein the locating pin comprises a bevel to ease sliding the collar onto the locating pin.

15. The system of claim 7 wherein the collar comprises a bevel to ease sliding the collar onto the locating pin.

16. The system of claim 5 wherein the locating pin has a centerline and is attached at a point offset from the centerline to the nominal location of the pottery wheel.

17. The system of claim 16 wherein:

the pottery wheel has holes at the nominal locations;

the locating pin is fabricated with a hole having a centerline offset from the centerline of the locating pin; and the locating pin is attached to the pottery wheel by means of a bolt through the hole in the locating pin and the hole in the pottery wheel.

18. The system of claim 17 wherein the locating pin is fabricated so the head of the bolt does not protrude beyond the locating pin.

19. The system of claim 18 wherein the bolt is a flat head screw, and the locating pin is fabricated with a bevel so the head of the flat head screw does not protrude beyond the locating pin.

20. The system of claim 18 wherein the bolt is a round head screw, and the locating pin is fabricated with a countersink so the head of the round head screw does not protrude beyond the locating pin.

21. The system of claim 16 wherein:

the pottery wheel has holes at the nominal locations;

the locating pin includes a threaded extension having a centerline offset from the centerline of the locating pin; and the locating pin is attached to the pottery wheel by inserting the threaded extension through the hole in the pottery wheel.

22. The system of claim 21 further comprising a screwdriver slot to ease alignment and attachment of the locating pin to the pottery wheel.

23. The system of claim 16 wherein:

the pottery wheel has holes at the nominal locations;

the locating pin comprises:

a main body having a centerline, and forming an opening having a centerline offset from the centerline of the main body; and an insert having a centerline, and a threaded extension having a centerline offset from the centerline of the insert;

the main body and the insert are formed for the insert to rotatably fit in the opening of the main body; and the locating pin is attached to the pottery wheel by inserting the threaded extension through the hole in the pottery wheel.

24. The system of claim 23 wherein:

the opening in the main body is substantially frustrum-shaped; and the insert is substantially frustrum-shaped, and formed to rotatably fit in the frustrum-shaped opening in the main body.

25. The system of claim 24 wherein:

the main body comprises a hole having a centerline at the centerline of the insert;

the insert comprises an internally threaded hole at the centerline of the insert; and the insert is held within the opening of the main body by a bolt through the hole in the main body and threaded into the internal threads in the insert.

26. The system of claim 25 wherein the main body is fabricated so the head of the bolt does not protrude beyond the main body.

27. The system of claim 26 wherein the bolt is a flat head screw, and the main body is fabricated with a bevel so the head of the flat head screw does not protrude beyond the main body.

28. The system of claim 26 wherein the bolt is a round head screw, and the main body is fabricated with a countersink so the head of the round head screw does not protrude beyond the main body.

29. An accessory adapted for use on a pottery wheel comprising a locating pin attached to a nominal location, the location of the locating pin being adjustable, the accessory comprising:

a hole, adapted to slidably fit over the locating pin, at a location corresponding to the nominal location; whereby:

the locating pin may be adjusted to align with the location of the hole and the accessory may be slid onto the location pin.

30. The accessory of claim 29 wherein the accessory is a bat.

31. The accessory of claim 30 wherein the bat is a non-porous bat comprising a collar forming a hole adapted to slidably fit over the locating pin and fabricated in the non-porous bat at a location corresponding to the nominal location.

32. The accessory of claim 31 wherein the non-porous bat is fabricated of plaster.

33. The accessory of claim 31 wherein the collar comprises a means for being retained when fabricated in the non-porous bat.

34. The accessory of claim 33 wherein the retaining means comprises a notch formed in the periphery of the collar.

35. The accessory of claim 33 wherein the retaining means comprises a flange formed on the periphery of the collar.

36. The accessory of claim 31 wherein the collar comprises a bevel to ease sliding the collar onto the locating pin.

37. A pottery wheel adapted for mounting an accessory comprising a hole fabricated at a location corresponding to a nominal location on the pottery wheel, the pottery wheel comprising:

a locating pin attached to the pottery wheel at a nominal location, the location of the locating pin being adjustable; whereby:

the hole is adapted to slidably fit over the locating pin; and the locating pin may be adjusted to align with the location of the hole in the accessory and the accessory may be slid onto the locating pin.

38. The pottery wheel of claim 37 wherein the locating pin comprises means for securely holding the accessory.

39. The pottery wheel of claim 38 wherein the locating pin comprises:

a notch adapted to contain an o-ring; and an o-ring in the notch.

40. The pottery wheel of claim 37 wherein the locating pin comprises a bevel to ease sliding the hole onto the locating pin.

41. The pottery wheel of claim 37 wherein the locating pin has a centerline and is attached at a point offset from the centerline to the nominal location of the pottery wheel.

42. The pottery wheel of claim 41 wherein:

the pottery wheel has holes at the nominal locations;

the locating pin is fabricated with a hole having a centerline offset from the centerline of the locating pin; and the locating pin is attached to the pottery wheel by means of a bolt through the hole in the locating pin and the hole in the pottery wheel.

43. The pottery wheel of claim 42 wherein the locating pin is fabricated so the head of the bolt does not protrude beyond the locating pin.

44. The pottery wheel of claim 43 wherein the bolt is a flat head screw, and the locating pin is fabricated with a bevel so the head of the flat head screw does not protrude beyond the locating pin.

45. The pottery wheel of claim 43 wherein the bolt is a round head screw, and the locating pin is fabricated with a countersink so the head of the round head screw does not protrude beyond the locating pin.

46. The pottery wheel of claim 41 wherein:

the pottery wheel has holes at the nominal locations;

the locating pin includes a threaded extension having a centerline offset from the centerline of the locating pin; and the locating pin is attached to the pottery wheel by inserting the threaded extension through the hole in the pottery wheel.

47. The pottery wheel of claim 46 further comprising a screwdriver slot to ease attachment of the locating pin to the pottery wheel.

48. The pottery wheel of claim 41 wherein:

the pottery wheel has holes at the nominal locations;

the locating pin comprises:

a main body having a centerline, and forming an opening having a centerline offset from the centerline of the main body; and an insert having a centerline, and a threaded extension having a centerline offset from the centerline of the insert;

the main body and the insert are formed for the insert to rotatably fit in the opening of the main body; and the locating pin is attached to the pottery wheel by inserting the threaded extension through the hole in the pottery wheel.

49. The pottery wheel of claim 48 wherein:

the opening in the main body is substantially frustrum-shaped; and the insert is substantially frustrum-shaped, and formed to rotatably fit in the frustrum-shaped opening in the main body.

50. The pottery wheel of claim 49 wherein:

the main body comprises a hole having a centerline at the centerline of the insert;

the insert comprises an internally threaded hole at the centerline of the insert; and the insert is held within the opening of the main body by a bolt through the hole in the main body and threaded into the internal threads in the insert.

51. The pottery wheel of claim 50 wherein the main body is fabricated so the head of the bolt does not protrude beyond the main body.

52. The pottery wheel of claim 51 wherein the bolt is a flat head screw, and the main body is fabricated with a bevel so the head of the flat head screw does not protrude beyond the main body.

53. The pottery wheel of claim 51 wherein the bolt is a round head screw, and the main body is fabricated with a countersink so the head of the round head screw does not protrude beyond the main body.

54. A kit for facilitating removably mounting an accessory on a pottery wheel, comprising:

a locating pin capable of being attached on a pottery wheel at a nominal location and having an adjustable location; and a collar, capable of being fabricated in the accessory at a location corresponding to the nominal location; whereby:

when the locating pin is attached on the pottery wheel at the nominal location and the collar is fabricated in the accessory at a location corresponding to the nominal location, the locating pin may be adjusted to align with the collar and the accessory may be removably attached to the pottery wheel.

55. The kit of claim 54 wherein the locating pin comprises means for securely holding the accessory.

56. The kit of claim 55 wherein:

the locating pin comprises a notch adapted to contain an o-ring; and the kit further comprises an o-ring in the notch.

57. The kit of claim 54 wherein the locating pin comprises a bevel to ease sliding the hole onto the locating pin.

58. The kit of claim 54 wherein the locating pin has a centerline and is attached at a point offset from the centerline to the nominal location of the pottery wheel.

59. The kit of claim 54 wherein:

the pottery wheel has a hole at the nominal location;

the locating pin is fabricated with a hole having a centerline offset from the centerline of the locating pin; and the locating pin is attachable to the pottery wheel by means of a bolt through the hole in the locating pin and the hole in the pottery wheel.

60. The kit of claim 59 wherein the kit further comprises the bolt.

61. The kit of claim 59 wherein the locating pin is fabricated so the head of the bolt does not protrude beyond the locating pin when the locating pin is attached to the pottery wheel.

62. The kit of claim 61 wherein the bolt is a flat head screw, and the locating pin is fabricated with a bevel so the head of the flat head screw does not protrude beyond the locating pin when the locating pin is attached to the pottery wheel.

63. The kit of claim 61 wherein the bolt is a round head screw, and the locating pin is fabricated with a countersink so the head of the round head screw does not protrude beyond the locating pin when the locating pin is attached to the pottery wheel.

64. The kit of claim 54 wherein:

the pottery wheel has a hole at the nominal location;

the locating pin includes a threaded extension having a centerline offset from the centerline of the locating pin; and the locating pin is attachable to the pottery wheel by inserting the threaded extension through the hole in the pottery wheel.

65. The kit of claim 64 further comprising a screwdriver slot to ease attachment of the locating pin to the pottery wheel.

66. The kit of claim 54 wherein:

the pottery wheel has a hole at the nominal location;

the locating pin comprises:

a main body having a centerline, and forming an opening having a centerline offset from the centerline of the main body; and an insert having a centerline, and a threaded extension having a centerline offset from the centerline of the insert;

the main body and the insert are formed for the insert to rotatably fit in the opening of the main body; and the locating pin is attachable to the pottery wheel by inserting the threaded extension through the hole in the pottery wheel.

67. The kit of claim 66 wherein:

the opening in the main body is substantially frustrum-shaped; and the insert is substantially frustrum-shaped, and formed to rotatably fit in the frustrum-shaped opening in the main body.

68. The kit of claim 67 wherein:

the main body comprises a hole having a centerline at the centerline of the insert;

the insert comprises an internally threaded hole at the centerline of the insert;

the insert may be held within the opening of the main body by a bolt through the hole in the main body and threaded into the internal threads in the insert; and the kit further comprises the bolt.

69. The kit of claim 68 wherein the main body is fabricated so the head of the bolt does not protrude beyond the main body when the insert is fit into the main body.

70. The kit of claim 69 wherein the bolt is a flat head screw, and the main body is fabricated with a bevel so the head of the flat head screw does not protrude beyond the main body when the insert is fit into the main body.

71. The kit of claim 69 wherein the bolt is a round head screw, and the main body is fabricated with a countersink so the head of the round head screw does not protrude beyond the main body when the insert is fit into the main body.

72. The kit of claim 54 wherein the accessory is a plaster bat and the collar comprises a means for being retained when fabricated in the plaster bat.

73. The kit of claim 72 wherein the retaining means comprises a notch formed in the periphery of the collar.

74. The kit of claim 72 wherein the retaining means comprises a flange formed on the periphery of the collar.

75. The kit of claim 54 wherein the collar comprises a bevel to ease sliding the collar onto the locating pin.

76. A kit for fabricating an accessory which may be removably mounted on a pottery wheel comprising a locating pin attached to the pottery wheel at a nominal location, the locating pin having an adjustable location, the kit comprising:

a collar, adapted to slidably fit on the locating pin, capable of being fabricated in the accessory at a location corresponding to a nominal location on a pottery wheel; whereby:

when the collar is fabricated in the accessory at a location corresponding to the nominal location the locating pin may be adjusted to align with the collar and the accessory may be removably attached to the pottery wheel.

77. The kit of claim 76 wherein the accessory is a plaster bat and the collar comprises a means for being retained when fabricated in the plaster bat.

78. The kit of claim 77 wherein the retaining means comprises a notch formed in the periphery of the collar.

79. The kit of claim 77 wherein the retaining means comprises a flange formed on the periphery of the collar.

80. The kit of claim 76 wherein the collar comprises a bevel to ease sliding the collar onto the locating pin.

81. A kit for facilitating removably mounting an accessory on a pottery wheel, the accessory comprising a hole fabricated at a location corresponding to a nominal location on the pottery wheel, the kit comprising:

a locating pin, adapted to slidably fit in the hole in the accessory, capable of being attached on a pottery wheel at the nominal location and having an adjustable location; whereby:

when the locating pin is attached on the pottery wheel at the nominal location, the location of the locating pin may be adjusted to align with the hole in the accessory and the accessory may be removably attached to the pottery wheel.

82. The kit of claim 81 wherein the locating pin comprises means for securely holding the accessory.

83. The kit of claim 82 wherein:

the locating pin comprises a notch adapted to contain an o-ring; and the kit further comprises an o-ring adapted to fit in the notch.

84. The kit of claim 81 wherein the locating pin comprises a bevel to ease sliding the hole onto the locating pin.

85. The kit of claim 81 wherein the locating pin has a centerline and is attachable at a point offset from the centerline to the nominal location of the pottery wheel.

86. The kit of claim 81 wherein:

the pottery wheel has a hole at the nominal location;

the locating pin is fabricated with a hole having a centerline offset from the centerline of the locating pin; and the locating pin is attachable to the pottery wheel by means of a bolt through the hole in the locating pin and the hole in the pottery wheel.

87. The kit of claim 86 wherein the kit further comprises the bolt.

88. The kit of claim 86 wherein the locating pin is fabricated so the head of the bolt does not protrude beyond the locating pin when the locating pin is attached to the pottery wheel.

89. The kit of claim 88 wherein the bolt may be a flat head screw, and the locating pin is fabricated with a bevel so the head of the flat head screw does not protrude beyond the locating pin when the locating pin is attached to the pottery wheel.

90. The kit of claim 88 wherein the bolt may be a round head screw, and the locating pin is fabricated with a countersink so the head of the round head screw does not protrude beyond the locating pin when the locating pin is attached to the pottery wheel.

91. The kit of claim 81 wherein:

the pottery wheel has a hole at the nominal location;

the locating pin includes a threaded extension having a centerline offset from the centerline of the locating pin; and the locating pin is attachable to the pottery wheel by inserting the threaded extension through the hole in the pottery wheel.

92. The kit of claim 91 wherein the locating pin further comprises a screwdriver slot to ease attachment of the locating pin to the pottery wheel.

93. The kit of claim 81 wherein:

the pottery wheel has a hole at the nominal location;

the locating pin comprises:

a main body having a centerline, and forming an opening having a centerline offset from the centerline of the main body; and an insert having a centerline, and a threaded extension having a centerline offset from the centerline of the insert;

the main body and the insert are formed for the insert to rotatably fit in the opening of the main body; and the locating pin is attachable to the pottery wheel by inserting the threaded extension through the hole in the pottery wheel.

94. The kit of claim 93 wherein:

the opening in the main body is substantially frustrum-shaped; and the insert is substantially frustrum-shaped, and formed to rotatably fit in the frustrum-shaped opening in the main body.

95. The kit of claim 94 wherein:

the main body comprises a hole having a centerline at the centerline of the insert;

the insert comprises an internally threaded hole at the centerline of the insert;

the insert may be held within the opening of the main body by a bolt through the hole in the main body and threaded into the internal threads in the insert; and the kit further comprises the bolt.

96. The kit of claim 95 wherein the main body is fabricated so the head of the bolt does not protrude beyond the main body.

97. The kit of claim 96 wherein the bolt is a flat head screw, and the main body is fabricated with a bevel so the head of the flat head screw does not protrude beyond the main body when the insert is fit into the main body.

98. The kit of claim 96 wherein the bolt is a round head screw, and the main body is fabricated with a countersink so the head of the round head screw does not protrude beyond the main body when the insert is fit into the main body.

* * * * *